US012687010B2

(12) United States Patent
Woodworth

(10) Patent No.: US 12,687,010 B2
(45) Date of Patent: Jul. 21, 2026

(54) STRUT ANCHOR REMOVAL SYSTEM AND METHOD

(71) Applicant: Raymond Woodworth, Salem, OR (US)

(72) Inventor: Raymond Woodworth, Salem, OR (US)

( * ) Notice: Subject to any disclaimer, the term of this patent is extended or adjusted under 35 U.S.C. 154(b) by 386 days.

(21) Appl. No.: 18/240,087

(22) Filed: Aug. 30, 2023

(65) Prior Publication Data

US 2025/0075489 A1 Mar. 6, 2025

(51) Int. Cl.
*B25B 13/08* (2006.01)
*E04B 1/38* (2006.01)

(52) U.S. Cl.
CPC ..... *E04B 1/388* (2023.08); *E04B 2001/389* (2023.08)

(58) Field of Classification Search
CPC ..... B25B 13/08; B25B 31/00; F16B 2200/20; E04B 1/388; E04B 2001/389
See application file for complete search history.

(56) References Cited

U.S. PATENT DOCUMENTS

D329,788 S * 9/1992 Andrew ..... D8/17
5,156,233 A 10/1992 Olsen
5,924,260 A 7/1999 Austin
6,023,833 A * 2/2000 Jacobsmeier ..... B25B 31/00 29/243.56
6,745,648 B2 * 6/2004 Stier ..... B25B 13/08 81/176.1
7,992,680 B2 8/2011 Small
7,996,971 B2 * 8/2011 Newton ..... B25B 9/02 269/3
8,567,029 B2 * 10/2013 Oymaian ..... B25B 27/14 81/3.55
8,893,852 B2 11/2014 Liggett
D745,374 S 12/2015 Liu
10,060,146 B2 8/2018 Simmons
D910,390 S * 2/2021 Li ..... D8/27
D922,847 S * 6/2021 Wang ..... D12/400
11,229,811 B2 1/2022 Milbright

FOREIGN PATENT DOCUMENTS

WO WO2019166996 9/2019

* cited by examiner

*Primary Examiner* — Brian E Glessner
*Assistant Examiner* — Daniel J Kenny

(57) ABSTRACT

A strut anchor removal system for removing a strut anchor from a strut includes an actuating member and an anchor holding member. The actuating member is engageable with a locking pin of the strut anchor to move the strut anchor into a disengagement configuration. The anchor holding member is engageable with the strut anchor to hold the strut anchor from a distance and lower the strut anchor from a strut.

6 Claims, 10 Drawing Sheets

STRUT ANCHOR REMOVAL SYSTEM AND METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to removal tools and more particularly pertains to a new removal tool for removing a strut anchor from a strut.

(2) Description of Related Art Including Information Disclosed Under 37 CFR 1.97 and 1.98

The prior art discloses several methods and devices for anchoring safety lines and other objects to a strut channel or similar track. Some strut anchors which attach safety lines to struts comprise a pair of plates which are positionable in alternate configurations to engage or disengage a strut. Some such strut anchors move the pair of plates with respect to each other by operation of a locking pin which keeps the plates attached to each other and also allows for a convenient one-handed operation to alternately install or remove the strut anchor from the strut. However, in many situations, the strut may be difficult to reach due to factors such as significant height above a support surface and obstructions which block access to the strut. Consequently, users may not be able to reach the strut with the strut anchor using only their arms and an aerial work platform or other raised platform. The prior art discloses at least some ways of accessing such obstructed struts for installation of the strut anchor, but do not provide a solution to remove the strut anchor. A system is therefore needed to better reach installed strut anchors to remove them from their attached struts.

BRIEF SUMMARY OF THE INVENTION

An embodiment of the disclosure meets the needs presented above by generally comprising an actuating member which is elongated between a first actuator end and a second actuator end. The actuating member has a receiving hole extending perpendicularly therein adjacent to the first actuator end. The receiving hole has a size such that the receiving hole is configured for receiving a locking pin of a strut anchor. The actuating member may be urged against the locking pin when the receiving hole receives the locking pin to urge the locking pin against a bias of a bias member of the strut anchor to remove the locking pin from a locked position in which the locking pin maintains a first plate and a second plate of the strut anchor in an engagement configuration. Then the actuating member may be urged downwardly against the locking pin to urge the second plate downwardly with respect to the first plate to move the first and second plates from the engagement position to a disengagement position. An anchor holding member is elongated between a first holder end and a second holder end. The anchor holding member has a thickness at the first holder end such that the first holder end is configured to support the strut anchor via a hooked upper end of the first plate.

Another embodiment of the present disclosure includes a method of removing a strut anchor from a strut. The method includes positioning an anchor holding member to support the strut anchor when a first plate and a second plate of the strut anchor are positioned in an engagement configuration and hand from the strut. The strut anchor is lifted via the anchor holding member to move the strut anchor out of engagement with the strut. An actuating member is urged against the locking pin to move the locking pin out of a locked position. The actuating member is also urged downwardly against the locking pin to slide the second plate downwardly with respect to the first plate to cause the first and second plates of the strut anchor to move from the engagement configuration to a disengagement configuration. The strut anchor is lowered via the anchor holding member out of the strut.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

Figure 1:
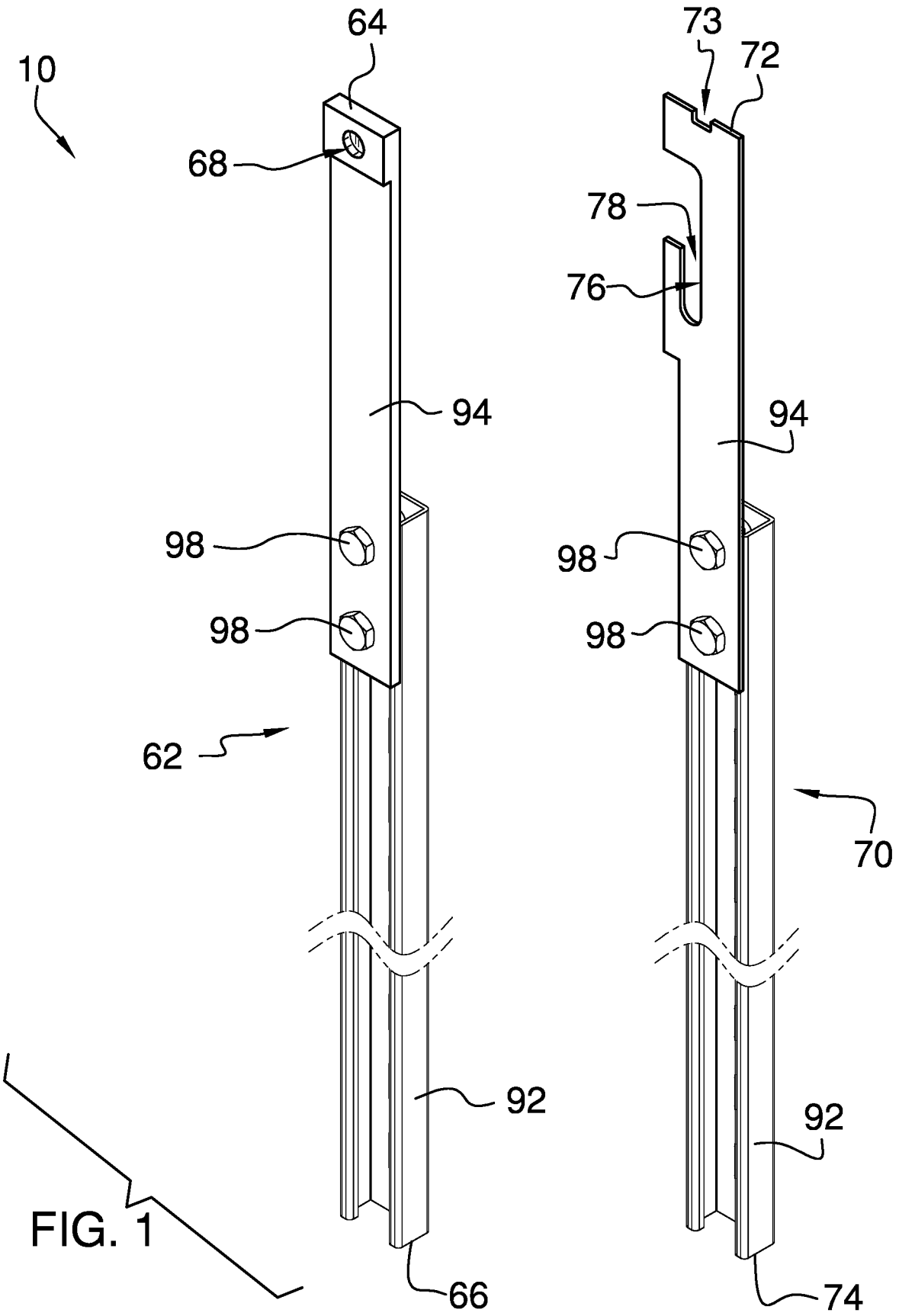
FIG. 1 is a perspective view of a strut anchor removal system according to an embodiment of the disclosure.
Figure 2:
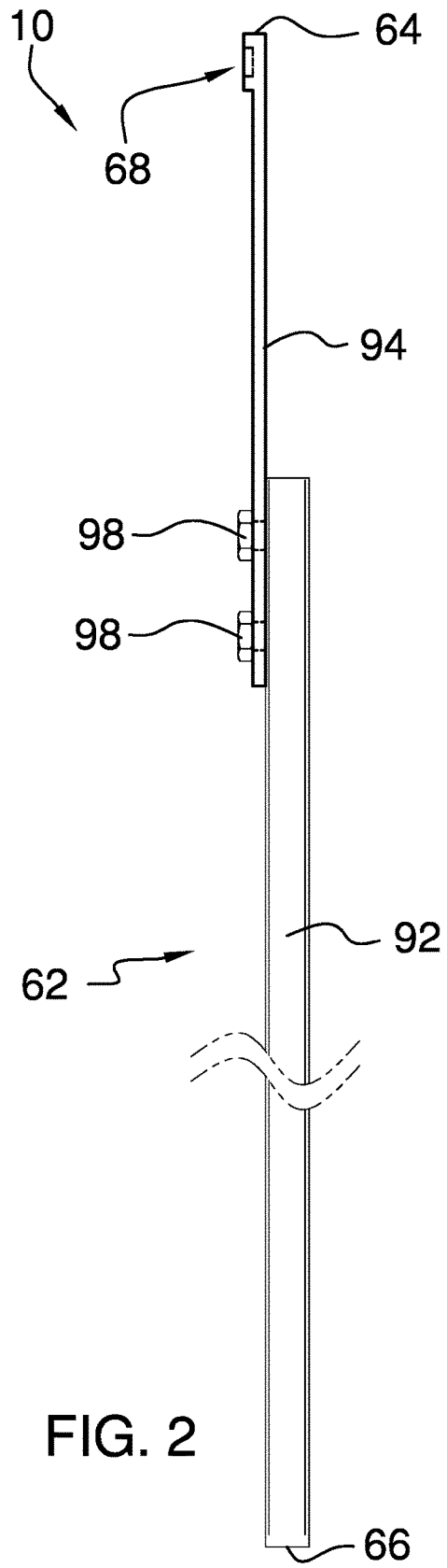
FIG. 2 is a side view of an actuator member of an embodiment of the disclosure.
Figure 3:
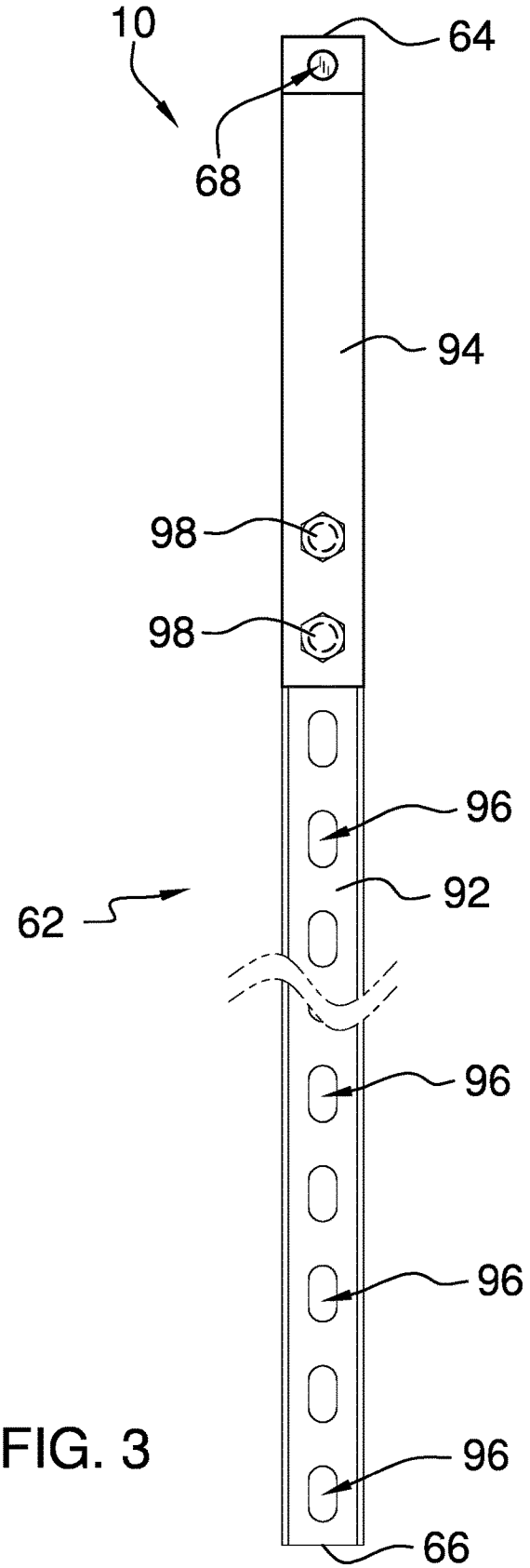
FIG. 3 is a front view of an actuator member of an embodiment of the disclosure.
Figure 4:
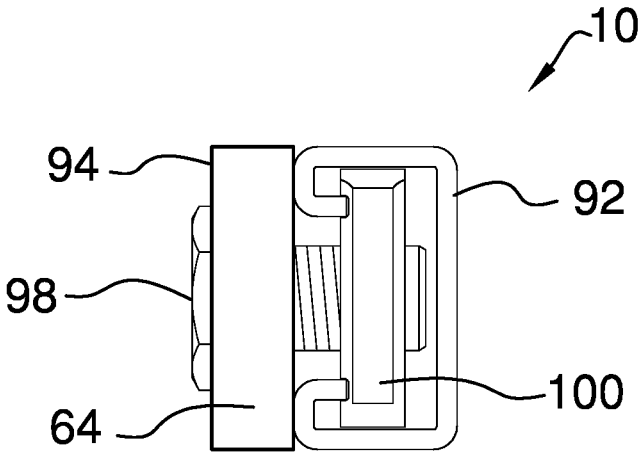
FIG. 4 is a top view of an actuator member of an embodiment of the disclosure.
Figure 5:
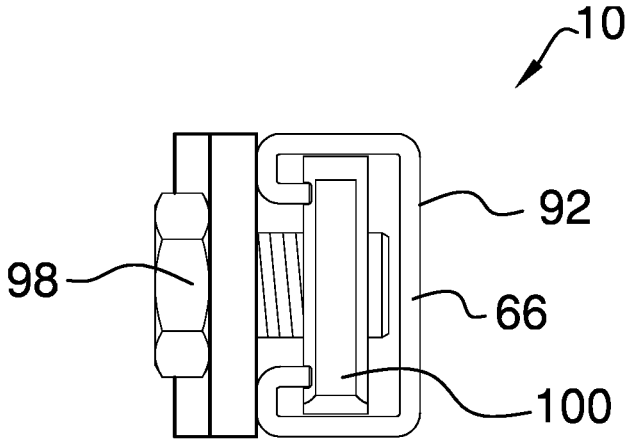
FIG. 5 is a bottom view of an actuator member of an embodiment of the disclosure.
Figure 6:
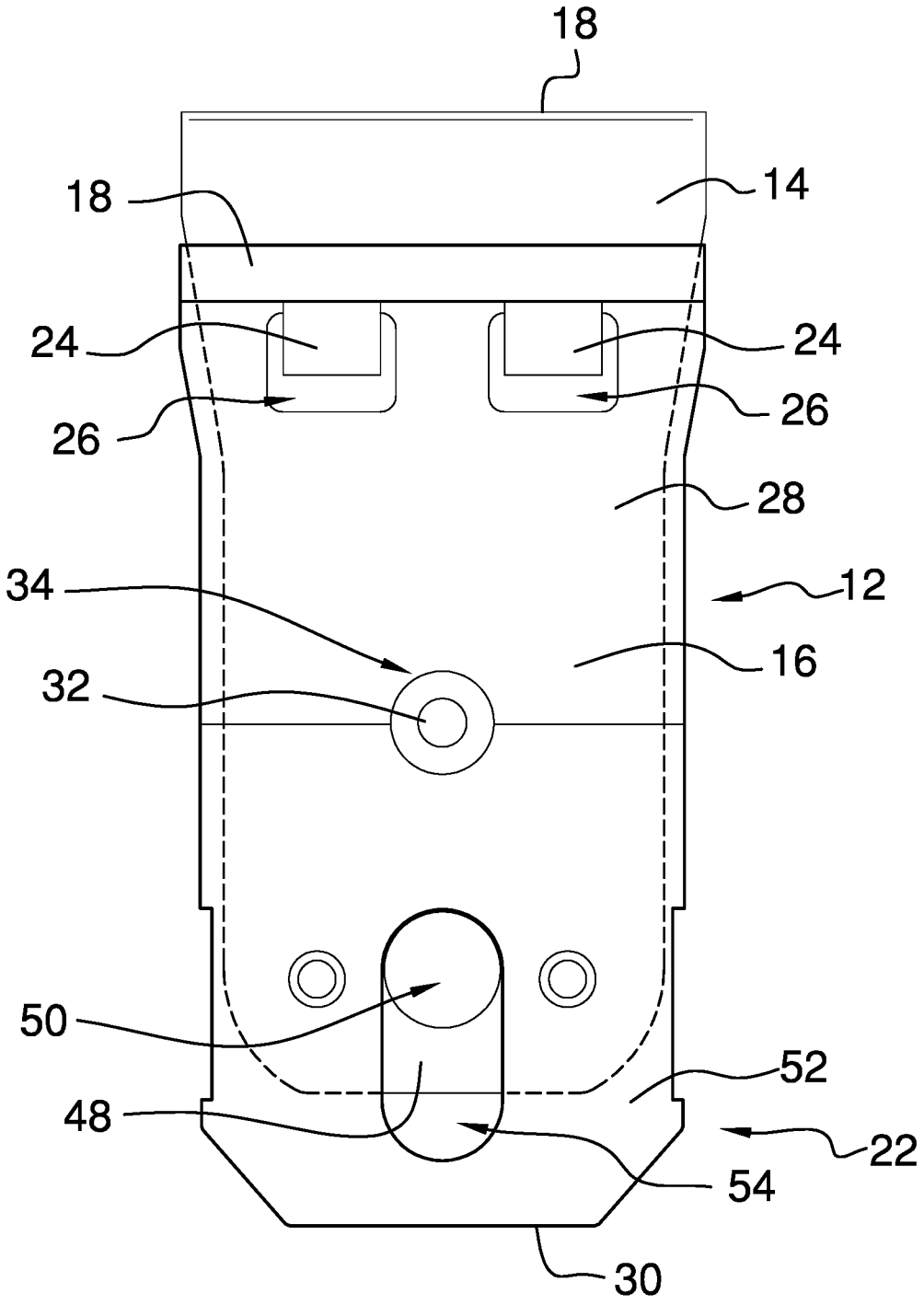
FIG. 6 (PRIOR ART)
FIG. 6 is a first side view of an exemplary strut anchor of the type which may be operated by the present invention in a disengagement configuration.
Figure 7:
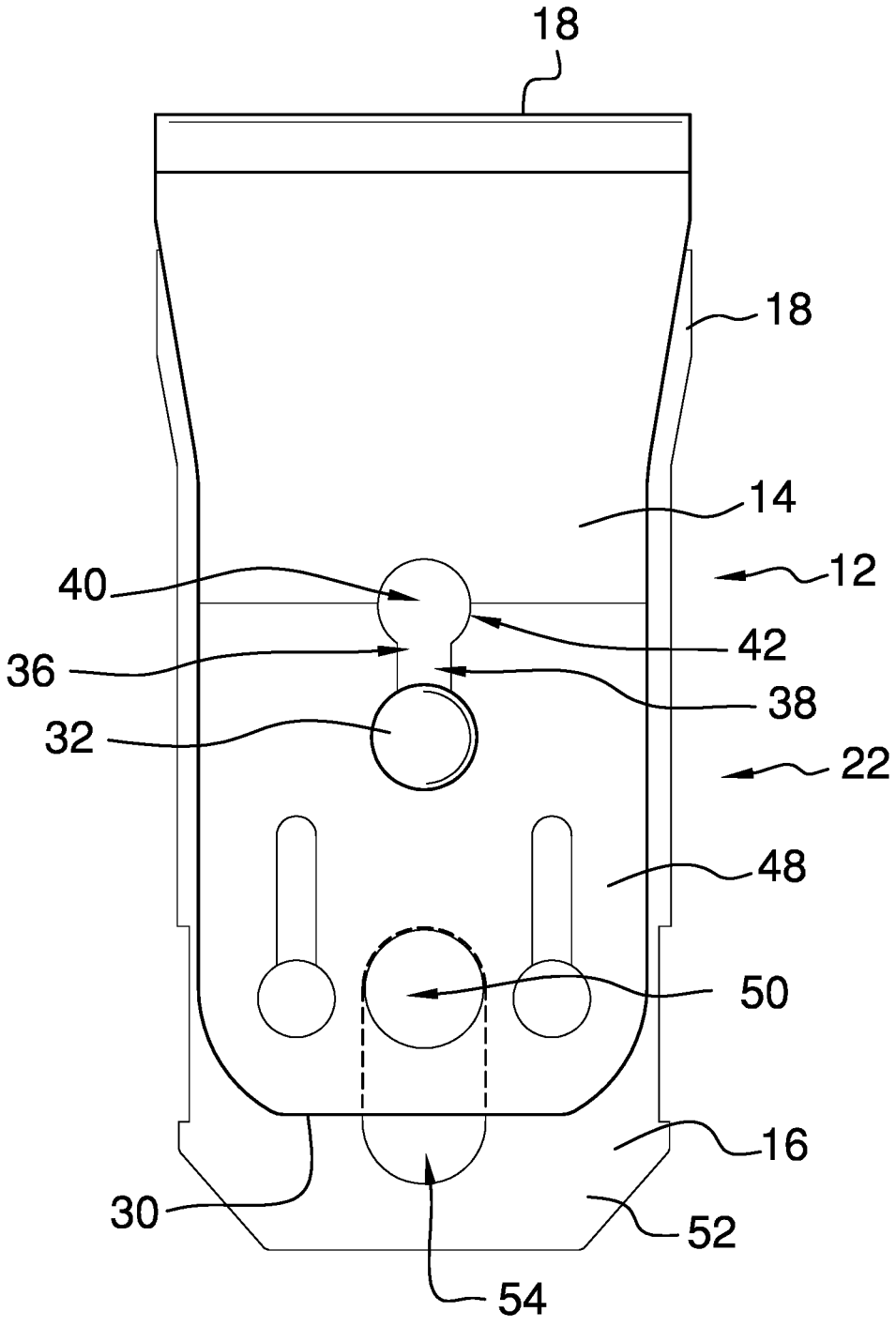
FIG. 7 (PRIOR ART)
FIG. 7 is a second side view of an exemplary strut anchor of the type which may be operated by the present invention in a disengagement configuration.
Figure 8:
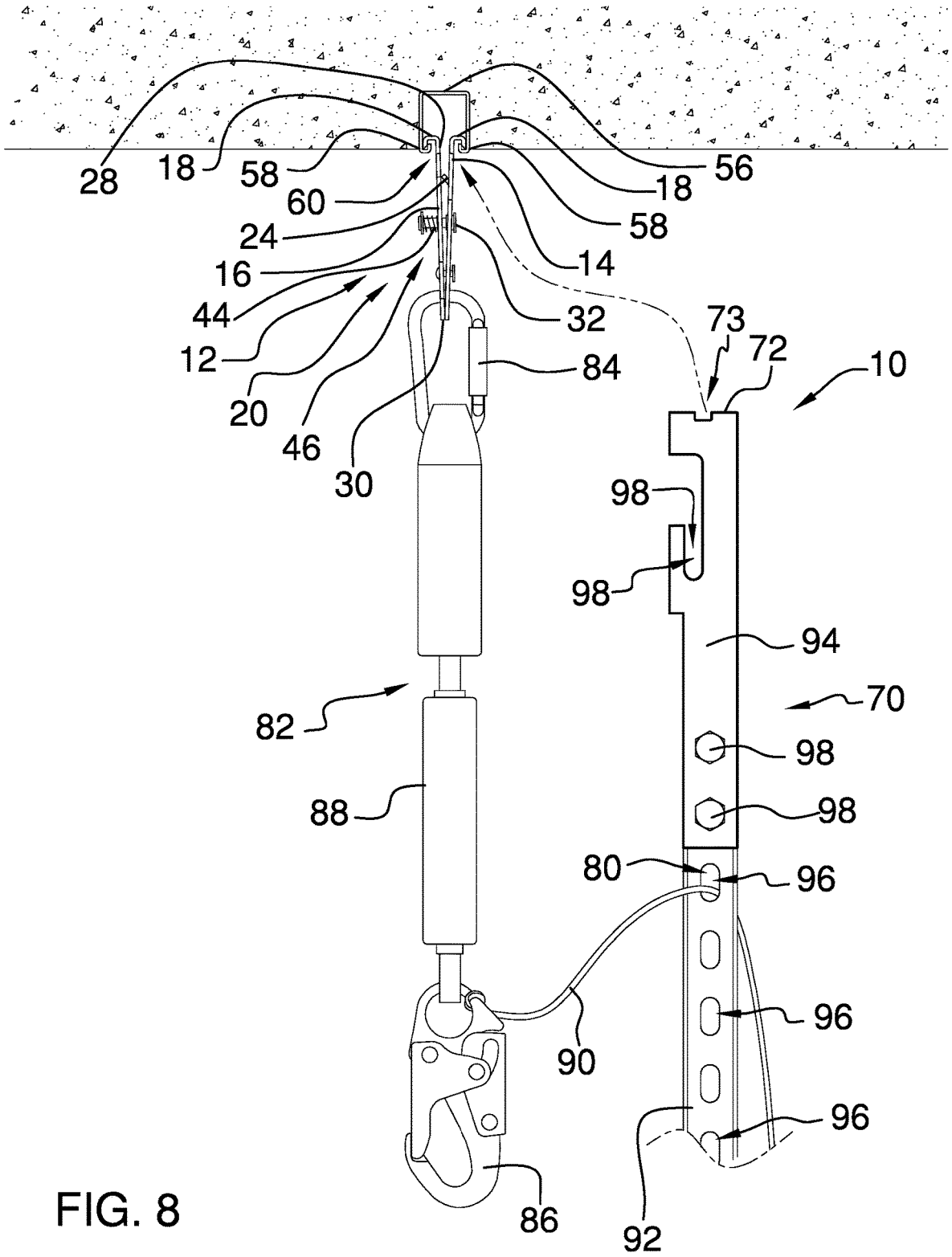
FIG. 8 is an in-use view of an embodiment of the disclosure. A strut anchor and a safety line assembly are depicted mounted to a strut, and an anchor holding member is depicted approaching the strut to lift and hold the strut anchor.
Figure 9:
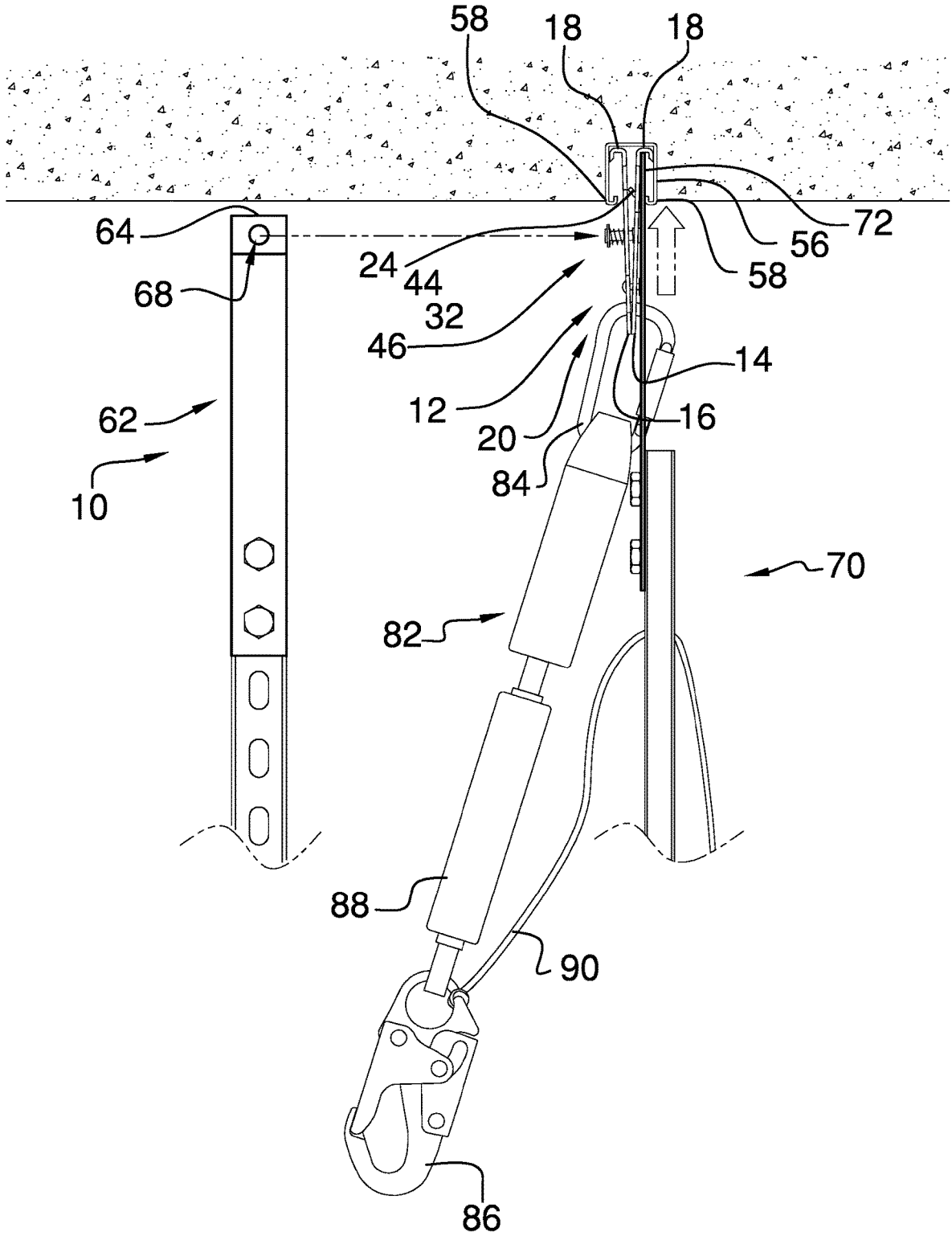

FIG. 9 is an in-use view of an embodiment of the disclosure. An anchor holding member is depicted holding a strut anchor above hooked ends of a strut. An actuator member is depicted approaching a locking pin.

Figure 10:
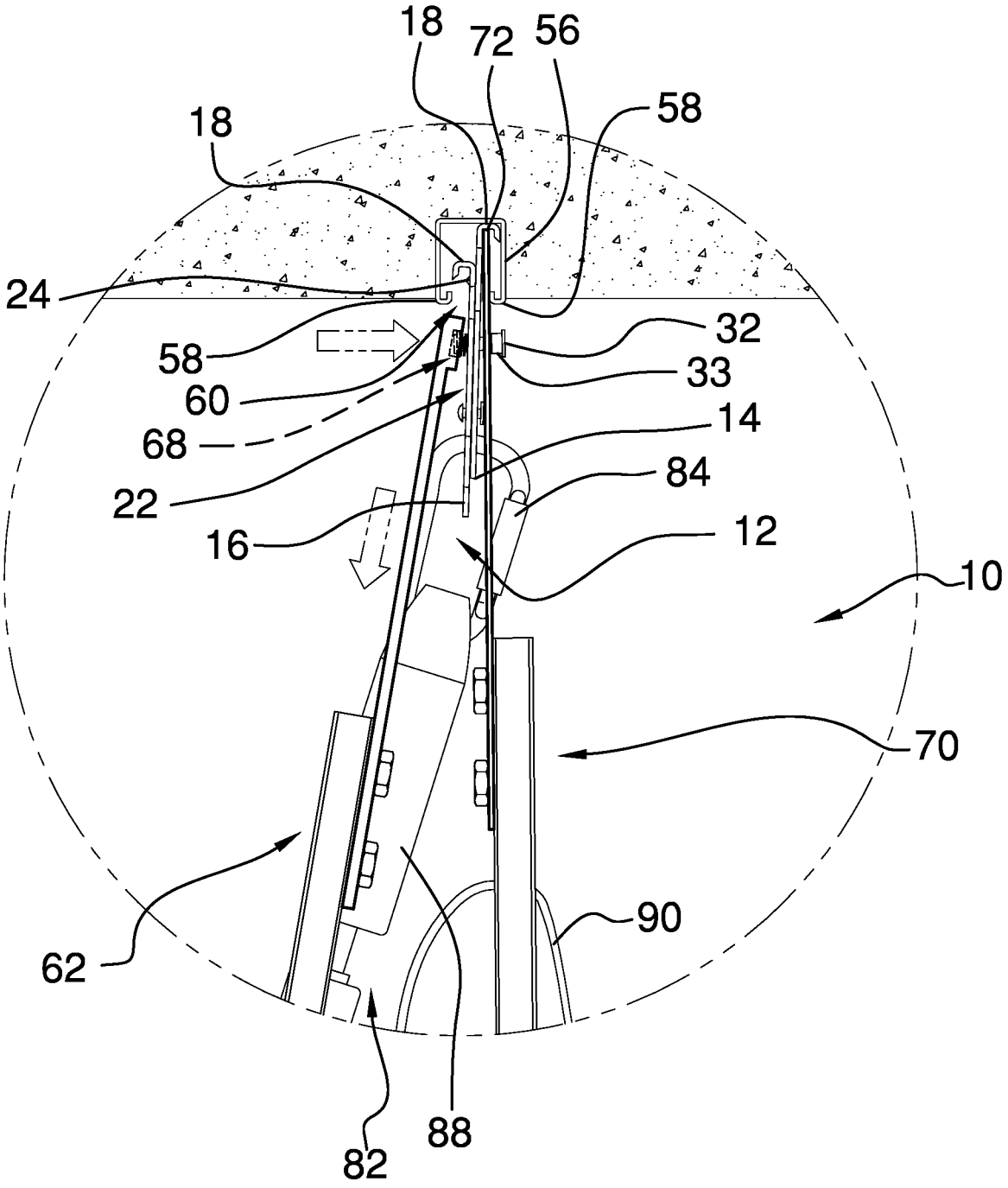

FIG. 10 is an in-use view of an embodiment of the disclosure. An anchor holding member is depicted holding a strut anchor above hooked ends of a strut. An actuator member is depicted engaging a locking pin to cause hooked upper ends of a pair of plates of the strut anchor to draw toward each other.

Figure 11:
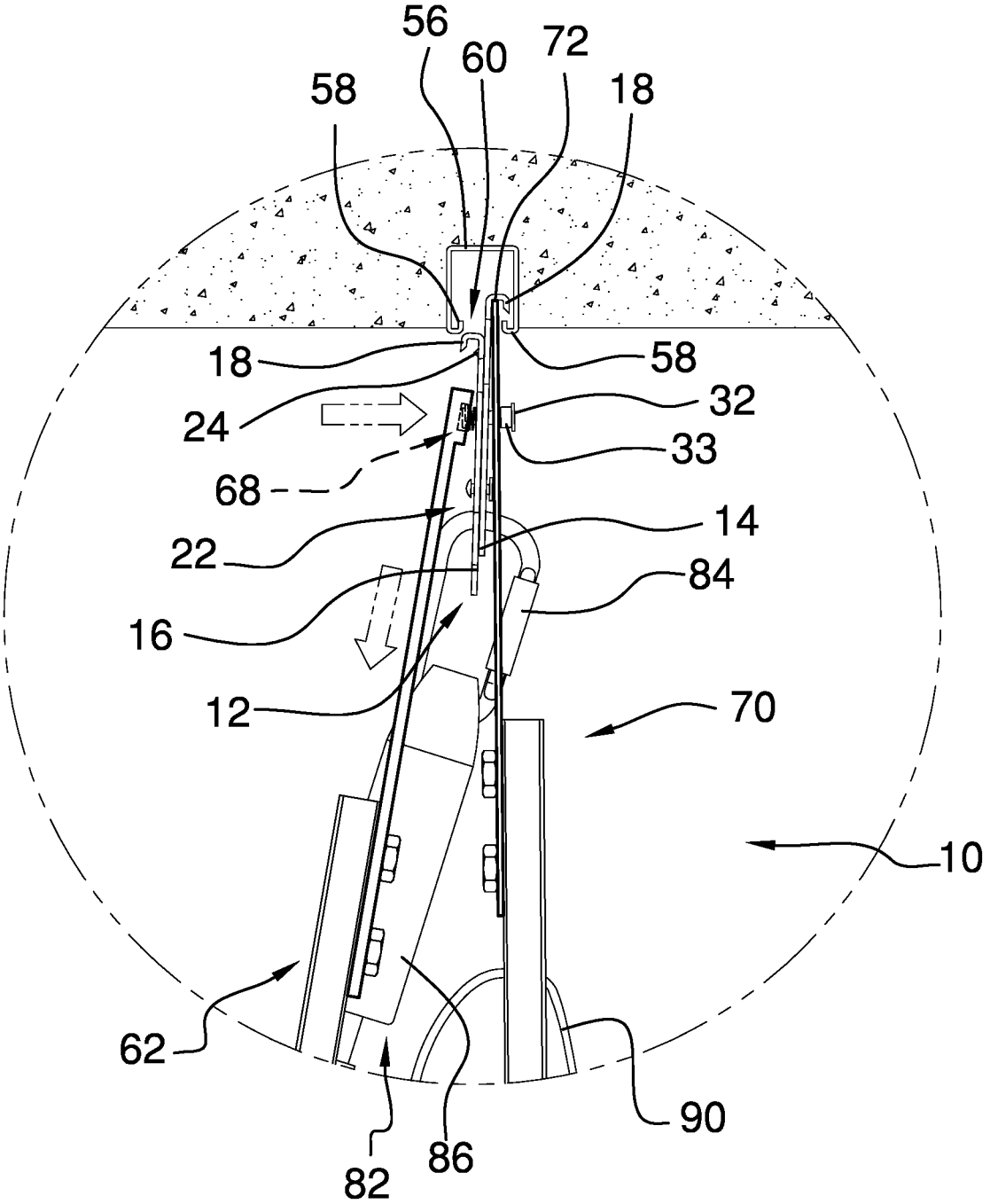

FIG. 11 is an in-use view of an embodiment of the disclosure. An anchor holding member is depicted lowering a strut anchor from a strut.

Figure 12:
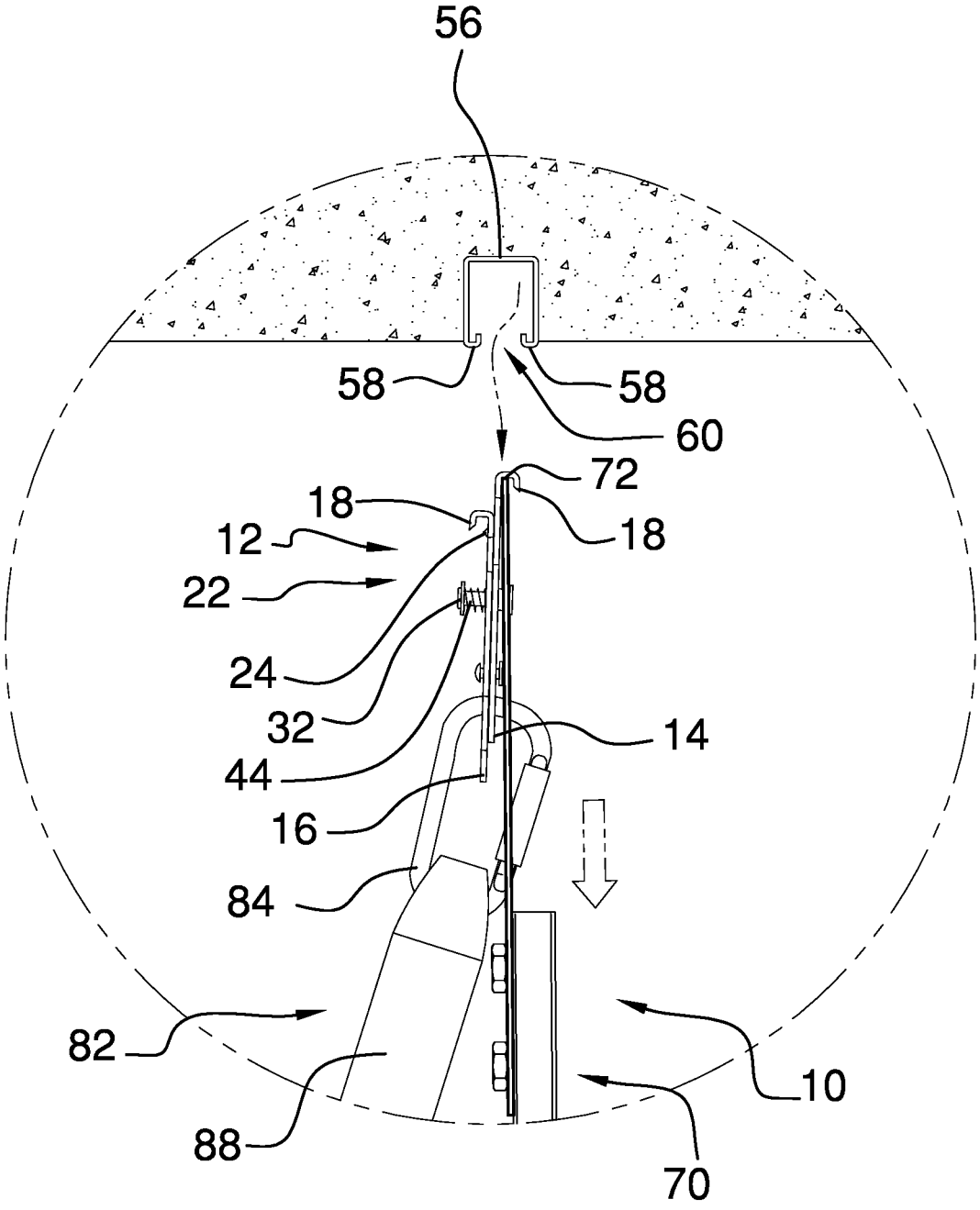

FIG. 12 is an in-use view of an embodiment of the disclosure. An anchor holding member is depicted lowering a strut anchor away from a strut.

DETAILED DESCRIPTION OF THE INVENTION

With reference now to the drawings, and in particular to FIGS. 1 through 12 thereof, a new removal tool embodying the principles and concepts of an embodiment of the disclosure and generally designated by the reference numeral 10 will be described.

The strut anchor removal system 10 is best illustrated in FIGS. 1 through 12 and is adapted for use in removing a strut anchor 12 from a strut 56. An exemplary strut anchor 12 which may be removed by the strut anchor removal system 10 is depicted in FIGS. 6 through 12. The exemplary strut anchor 12 comprises a first plate 14 and a second plate 16 which are slidably coupled to each other such that the first and second plates 14, 16 are vertically slidable with respect to each other. Each one of the first and second plates 14, 16 has a hooked upper end 18 which is shaped to engage with an associated one of a pair of hooked edges 58 of the strut 56 so that the strut anchor 12 may hang from the strut 56 and be slidable along a length of the strut 56.

The first and second plates 14, 16 are positionable in a disengagement configuration 22 in which the hooked upper end 18 of the first plate 14 is positioned higher than the hooked upper end 18 of the second plate 16. In the disengagement configuration 22, the hooked upper ends 18 of the first and second plates 14, 16 are maintained near each other to allow the hooked upper ends 18 to fit through an opening 60 of the strut 56. The first and second plates 14, 16 are movable from the disengagement configuration 22 to an engagement configuration 20 by sliding the second plate 16 upwardly relative to the first plate 14 such that the hooked upper ends 18 are laterally aligned and spaced from each other such that the hooked upper ends 18 engage the hooked edges 58 of the strut 56 as described above. A spreader ramp 24 is attached to the first plate 14 and extends toward the second plate 16. The spreader ramp 24 extends into an accommodating hole 26 positioned in the second plate 16 when the first and second plates 14, 16 are positioned in the disengagement configuration 22. When the second plate 16 is moved upwardly relative to the first plate 14, the spreader ramp 24 urges an upper portion 28 of the second plate 16 away from the second plate 16, thereby spreading the hooked upper ends 18 of the first and second plates 14, 16 away from each other and positioning the first and second plates 14, 16 in the engagement configuration 20.

The exemplary strut anchor 12 further includes a locking pin 32 which extends through a lock opening 60 34 in the second plate 16 and a keyhole aperture 36 in the first plate 14. The keyhole aperture 36 comprises an elongated slot portion 38 and a shoulder receiving portion 40 which are in fluid communication with each other. The elongated slot portion 38 extends between a lower end 30 and the hooked upper end 18 of the second plate 16, and the shoulder receiving portion 40 is positioned at a top end 42 of the elongated slot portion 38. When the first and second plates 14, 16 are positioned in the disengagement configuration 22, the locking pin 32 is positioned in the elongated slot portion 38 of the keyhole aperture 36 and a biasing member 44 engages the locking pin 32 and the first plate 14 to urge a shoulder 33 of the locking pin 32 against the second plate 16, thereby urging the first and second plates 14, 16 toward each other.

When the first and second plates 14, 16 are positioned in the engagement configuration 20, the locking pin 32 extends through the shoulder receiving portion 40 of the keyhole aperture 36 and the biasing member 44 engages the locking pin 32 and the first plate 14 to urge the locking pin 32 into a locked position 46 wherein the shoulder 33 of the locking pin 32 is positioned in the shoulder receiving portion 40 of the keyhole aperture 36. The shoulder 33 of the locking pin 32 is wider than the elongated slot portion 38 of the keyhole aperture 36, so the locking pin 32 is prevented from sliding into the elongated slot portion 38 while the locking pin 32 is positioned in the locked position 46 until the bias of the biasing member 44 is counteracted. The locking pin 32 thereby retains the first and second plates 14, 16 in the engagement configuration 20 when the locking pin 32 is positioned in the locked position 46 of the keyhole aperture 36.

The first plate 14 has a connection hole 50 extending through a lower portion 48 of the first plate 14, and the second plate 16 has a connection slot 54 extending through a lower portion 52 of the first plate 16. The connection hole 50 and the connection slot 54 are used to simultaneously receive an upper connector 84 of a safety line assembly 82 to anchor the safety line assembly 82 to the strut 56. The upper connector 84 of the safety line assembly 82 may be a carabiner, a clip, a D-ring, a snap hook, or the like. The safety line assembly 82 will also typically have a lower connector 86 comprising a snap hook, a clip, a carabiner, a D-ring, or the like. The connection slot 54 is arranged so that the second plate 16 is permitted to slide with respect to the first plate 14 without impinging on the upper connector 84. The bottoms of the connection hole 50 and the connection slot 54 are laterally aligned when the first and second plates 14, 16 are positioned in the engagement configuration 20 such that the first plate 14 is movable downwardly with respect to the second plate 16 via urging from the upper connector 84 to move the first and second plates 14, 16 from the disengagement configuration 22 to the engagement configuration 20.

Referring to FIGS. 1 through 12, the strut anchor removal system 10 comprises an actuating member 62 for moving the first and second plates 14, 16 from the engagement configuration 20 to the disengagement configuration 22 and an anchor holding member 70 for supporting the strut anchor 12 and moving the strut anchor 12 from the strut 56. The actuating member 62 is elongated between a first actuator end 64 and a second actuator end 66 and has a receiving hole 68 extending perpendicularly therein adjacent to the first actuator end 64. The receiving hole 68 has a size such that the receiving hole 68 may receive the locking pin 32 of the strut anchor 12. The actuating member 62 may, after receiving the locking pin 32 into the receiving hole 68, be urged against the locking pin 32 to urge the locking pin 32 against the bias of the bias member of the strut anchor 12 to remove the locking pin 32 from the locked position 46. Then the actuating member 62 may be urged downwardly against the locking pin 32 to urge the second plate 16 downwardly with respect to the first plate 14 to move the first and second plates 14, 16 from the engagement configuration 20 to the disengagement configuration 22.

The anchor holding member 70 is used to hold the strut anchor 12 from a distance while the actuating member 62 is used on the strut anchor 12. The anchor holding member 70 is elongated between a first holder end 72 and a second holder end 74. The anchor holding member 70 has a thickness at the first holder end 72 such that the first holder end 72 may fit in and engage the hooked upper end 18 of the first plate 14 to support the anchor holding member 70. The anchor holding member 70 holds the strut anchor 12 so that the first and second plates 14, 16 may be slid vertically with respect to each other, and will be appreciated that other shapes of the anchor holding member 70 which are suitable for holding the strut anchor 12 in this manner are contemplated by the present disclosure.

The anchor holding member 70 also defines a stabilizing slot 76 which is positioned between the first holder end 72 and the second holder end 74. The stabilizing slot 76 has an open end 78 facing the first holder end 72. The stabilizing slot 76 has a width for receiving the upper connector 84 of the safety line assembly 82. The stabilizing slot 76 is also positioned at a distance from the first holder end 72 such that the stabilizing slot 76 may receive the upper connector 84 when the first holder end 72 engages the hooked upper end 18 of the first plate 14. The anchor holding member 70 further defines a tether receiving aperture 80 which has a size to receive a tether 90 which is attached to the safety line assembly 82.

The anchor holding member 70 may also be used to install the strut anchor 12 in the strut 56 by supporting the strut anchor 12 via the hooked upper end 18 of the first plate 14 and positioning the strut anchor 12 in the strut 56. The upper connector 84 may also be positioned in the stabilizing slot 76 during this process. The tether 90 is used to arrest a fall of the strut anchor 12 from the anchor holding member 70 during installation and removal. The anchor holding member 70 may also have a notch 73 in the first holder end 72 with a size for receiving the lower end 30 of the second plate 16. The notch 73 may be used during installation of the strut anchor 12. More particularly, the strut anchor 12 may be positioned in the strut 56 such that it hangs from the strut 56 via the hooked upper end 18 of the first plate 14. Then, the lower end 30 of the second plate 16 may be received into the notch 73 so that the anchor holding member 70 may push the second plate 16 upwardly into the strut 56 and slide upwardly with respect to the first plate 14 to position the first and second plates 14, 16 in the engagement configuration 20.

In some embodiments, the actuating member 62 and the anchor holding member 70 may be constructed using an additional strut channel 92 and a head piece 94. The head piece 94 of the actuating member 62 in such embodiments defines the receiving hole 68 of the actuating member 62, and the head piece 94 of the anchor holding member 70 defines the first holder end 72 and the stabilizing slot 76 of the anchor holding member 70. One of a plurality of slots 96 in the additional strut channel 92 of the anchor holding member 70 may define the tether receiving aperture 80. The head piece 94 of each of the actuating member 62 and the anchor holding member 70 may be attached to the additional strut channel 92 via an associated set of bolts 98 and strut nuts 100.

The strut anchor removal system 10 may be used to install the strut anchor 12 into the strut 56 as described above and may also be used to remove the strut anchor 12 from the strut 56. The removal of the strut anchor 12 from the strut 56 using the strut anchor removal system 10 is illustrated in another embodiment of the disclosure depicted in FIGS. 8 through 12, which includes a method of removing the strut anchor 12 from the strut 56. The method comprises positioning the anchor holding member 70 to support the strut anchor 12 by positioning the first holder end 72 of the anchor holding member 70 under the hooked upper end 18 of the first plate 14 while the first and second plates 14, 16 are positioned in the engagement configuration 20 and hang from the strut 56. The strut anchor 12 is lifted via the anchor holding member 70 to move the strut anchor 12 out of engagement with the strut 56. The actuating member 62 is moved to receive the locking pin 32 into the receiving hole 68, is urged against the locking pin 32 to move the locking pin 32 out of the locked position 46, and is urged to slide the second plate 16 downwardly with respect to the first plate 14 to cause the first and second plates 14, 16 to move from the engagement configuration 20 to the disengagement configuration 22. Then the strut anchor 12 is lowered via the anchor holding member 70 out of the strut 56.

The safety line assembly 82 may be used to stabilize the strut anchor 12 as it is held by the anchor holding member 70 by receiving the upper connector 84 of the safety line assembly 82 into the stabilizing slot 76 of the anchor holding member 70. The tether 90 may be tied to the lower connector 86 of the safety line assembly 82 and threaded through the tether receiving aperture 80 of the anchor holding member 70 to further secure the strut anchor 12 to the anchor holding member 70. If the strut anchor 12 moves off of the anchor holding member 70, the resultant fall of the strut anchor 12 will be arrested by holding the tether 90 distally from the safety line assembly 82 so that the strut anchor 12 hangs from the tether receiving aperture 80.

In some embodiments of the method, the safety line assembly 82 comprises a retractable line 88 which is coupled to and extends between the upper connector 84 and the lower connector 86 and is biased to retract. Before removal of the strut anchor 12, the tether 90 may be tied to the lower connector 86 of the safety line assembly 82 in these embodiments at a distance from the upper connector 84. Then, after threading the tether 90 through the tether receiving aperture 80, the safety line assembly 82 may be permitted to retract while a distal end of the tether 90 with respect to the safety line assembly 82 is held.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A method of removing a strut anchor from a strut, the method comprising:

with a first plate and a second plate of the strut anchor positioned in an engagement configuration and hanging from the strut, positioning an anchor holding member to support the strut anchor;

lifting the strut anchor via the anchor holding member to move the strut anchor out of engagement with the strut;

urging an actuating member against a locking pin to move the locking pin out of a locked position;

urging the second plate via the actuating member against the locking pin to slide downwardly with respect to the first plate, thereby causing the first and second plates of the strut anchor to move from the engagement configuration to a disengagement configuration; and lowering the strut anchor via the anchor holding member out of the strut.

2. The method of claim 1, wherein the step of positioning the anchor holding member to support the strut anchor further comprises positioning a first holder end of the anchor holding member under a hooked upper end of the first plate.

3. The method of claim 1, further comprising:

before urging the actuating member against the locking pin, receiving a locking pin of the strut anchor into a receiving hole of the actuating member.

4. The method of claim 1, wherein an upper connector of a safety line assembly is attached to the strut anchor, the method further comprising receiving the upper connector into a stabilizing slot of the anchor holding member to inhibit the strut anchor from being moved away from the first holder end of the anchor holding member.

5. The method of claim 1, further comprising:

before positioning the anchor holding member to support the strut anchor, with an upper connector of a safety line assembly attached to the strut anchor, tying a tether to a lower connector of the safety line assembly;

threading the tether through a tether receiving aperture of an anchor holding member; and if the strut anchor moves off of the anchor holding member, arresting a fall of the strut anchor via the tether against the anchor holding member.

6. The method of claim 5, further comprising:

before tying the tether to the lower connector, retaining the lower connector of the safety line assembly at a distance from the upper connector, wherein the safety line assembly comprises a retractable line which is coupled to and extends between the upper connector and the lower connector, wherein the retractable line is biased to retract; and releasing the lower connector to permit the retractable line to retract while holding a distal end of the tether with respect to the safety line assembly.

* * * * *